United States Patent [19]

Moline

[11] Patent Number: 4,707,913

[45] Date of Patent: Nov. 24, 1987

[54] TERMINAL APPLICATOR HAVING QUICK-ADJUST CONNECTING LINK

[75] Inventor: Edward F. Moline, Mukwonago, Wis.

[73] Assignee: Artos Engineering Company, New Berlin, Wis.

[21] Appl. No.: 902,631

[22] Filed: Sep. 2, 1986

[51] Int. Cl.[4] ..... H01R 43/04

[52] U.S. Cl. ..... 29/753; 29/566.2

[58] Field of Search ..... 29/33 G, 753, 751, 749, 29/566.2, 566.3

[56] References Cited

U.S. PATENT DOCUMENTS 3,274,664 9/1966 Andren et al. ..... 29/33 G 4,114,253 9/1978 Loomis et al. ..... 29/566.2

*Primary Examiner*—Carl E. Hall

*Attorney, Agent, or Firm*—James E. Nilles; Nicholas A. Kees

[57] ABSTRACT

An apparatus for crimping a terminal onto a stripped end of a wire lead, including an anvil positioned on a frame, and a movable die mounted on a shuttle on the frame so as to be reciprocally vertically slidable thereon. The die is positioned so as to align with the anvil in the indicated direction, and generally so that the die impacts on a terminal held on the upper surface of the anvil. An actuator, such as a shaft having an eccentrically mounted crankpin, is adapted to impart reciprocating motion to the die along said predetermined direction via a link having a variable length connected between the shuttle and the actuator. This link includes an adjusting bolt for adjusting the length of said link means during setup of the apparatus, and a stepped spacer for quickly and easily adjusting the length of the link between runs. The spacer has a plurality of steps of thickness about its periphery, each of said steps selectively engageable with a ridge on the surface opposing the steps, to thereby adjust the length of the link. The selective engagement is accomplished by rotating the spacer about the longitudinal axis of the link.

6 Claims, 9 Drawing Figures

TERMINAL APPLICATOR HAVING QUICK-ADJUST CONNECTING LINK

BACKGROUND OF THE INVENTION

This invention relates to a machine for applying terminals to the stripped ends of wire leads by aligning a stripped wire end with a terminal and crimping the terminal onto the wire end by pressing a die against an anvil with the terminal and stripped wire end positioned therebetween. In particular the invention relates to machines wherein an actuator operates the die by means of a link having an adjustable length.

Existing terminal applicator machines having the link arrangement as referred to above have generally been difficult to set up or reset for particular job runs. One such terminal applicator is disclosed in Andren, et al., U.S. Pat. No. 3,274,664. It is generally known that the length of the link must be adjusted once on assembly and setup. Fine adjustments may then have to be made before each run. It has also been generally true that to adjust the length of the link, a cumbersome and time consuming adjustment procedure was required, including loosening two lock nuts, turning a threaded rod for the actual length adjustment, and retightening the two lock nuts. In addition, this length adjustment procedure was followed on a trial and error basis, usually involving more than one try before the proper length setting was achieved. It can be clearly seen then that adjusting the machine, using the cumbersome length adjustment procedure described above, would result in substantial machine down time. It is apparent that a better method of adjustment for the length of this link is needed.

This invention relates to improvements to the apparatus and inventions described above and to solutions to the problems raised thereby.

SUMMARY OF THE INVENTION

The invention is an apparatus for crimping a terminal onto a stripped end of a wire lead. It includes an anvil positioned on a frame, and a die mounted on a shuttle on the frame so as to be reciprocally slidable thereon in a particular predetermined direction, generally vertically. The die is positioned so as to align with the anvil in the indicated direction, and generally so that the die impacts on an upper surface of the anvil. An actuator, such as a crank having an eccentrically mounted crankpin, is adapted to impart reciprocating motion to the die along said predetermined direction by means of a link having a variable length connected between the shuttle and the actuator. This link includes a threaded length adjustment means for adjusting the length of said link means during setup upon assembly of the apparatus, and a stepwise length adjustment means for quickly adjusting the length of said link means between runs without complex and time consuming mechanical intervention. The stepwise adjustment means may include an annular spacer having a plurality of steps of thickness about its periphery, each of said steps selectively engageable with a ridge on an opposing surface, to thereby adjust the length of the link. The selective engagement is accomplished by rotating the spacer about the longintudinal axis of the link. In one embodiment the spacer has a plurality of flats about its sides to facilitate the rotational selection of steps.

It is thus an object of the invention to provide an apparatus for attaching a terminal to a stripped end of a wire lead, wherein the link connecting the actuator to the shuttle carrying the die has a length that is adjustable in steps simply and quickly, as well as continuously if desired.

Another object of the invention is to provide an apparatus as described above wherein the link length is adjustable by means of a spacer having a plurality of steps of thickness about its periphery, each of which steps are selectively engageable with a ridge of an opposing surface of the link, so that the length of the link is adjustable by rotating the spacer about the longitudinal axis of the link.

A more specific object of the invention is to provide an apparatus as described above wherein the spacer has a plurality of flats about its sides to facilitate the rotation of the spacer to thereby select the proper spacer step.

Other objects and advantages of the invention will become apparent hereinafter.

DESCRIPTION OF THE PREFERRED EMBODIMENTS

Figure 1:
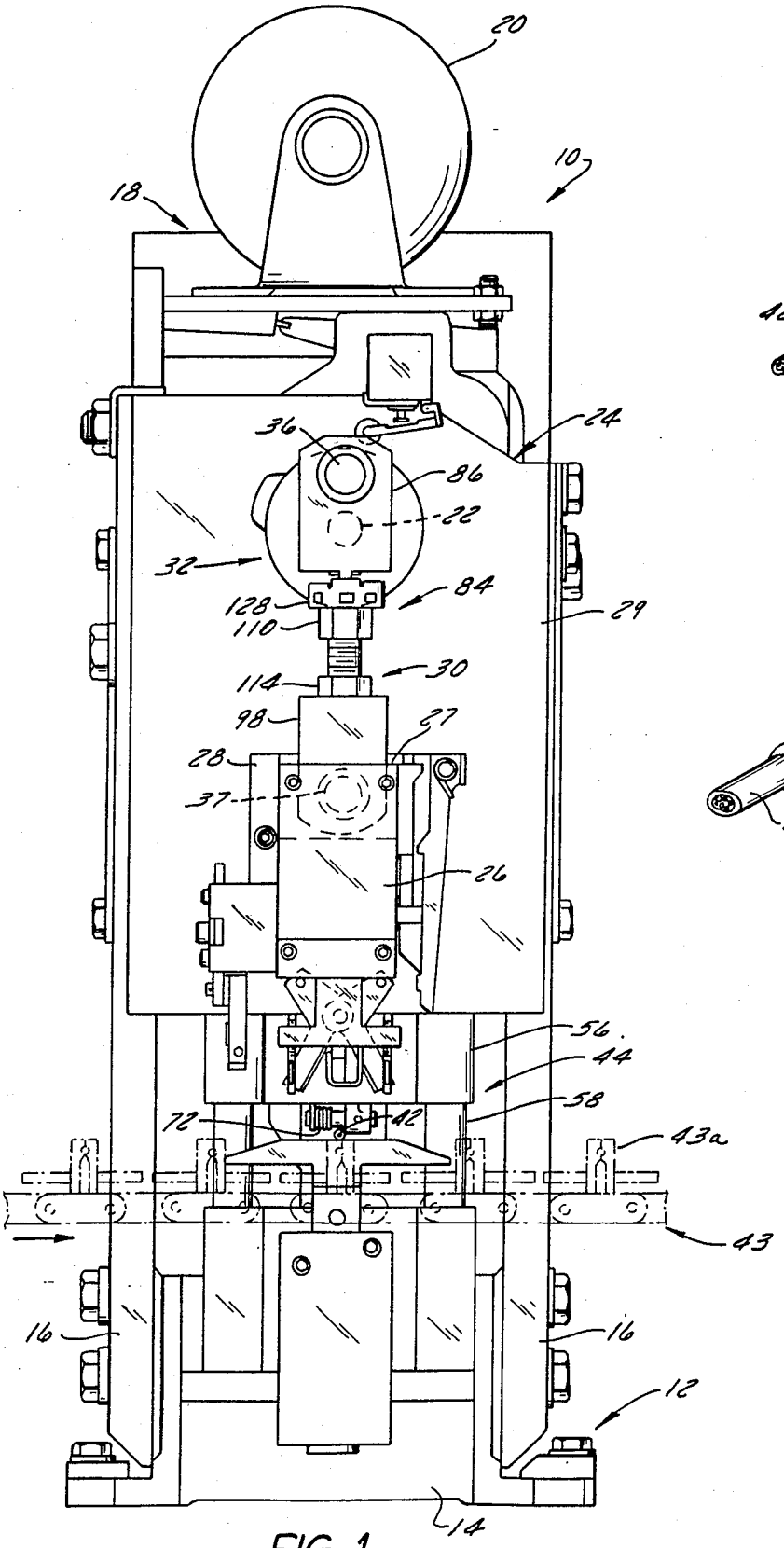
FIG. 1 is a plan view of a terminal applicator apparatus constructed according to the invention, showing the link and die in the raised position.
Figure 2:
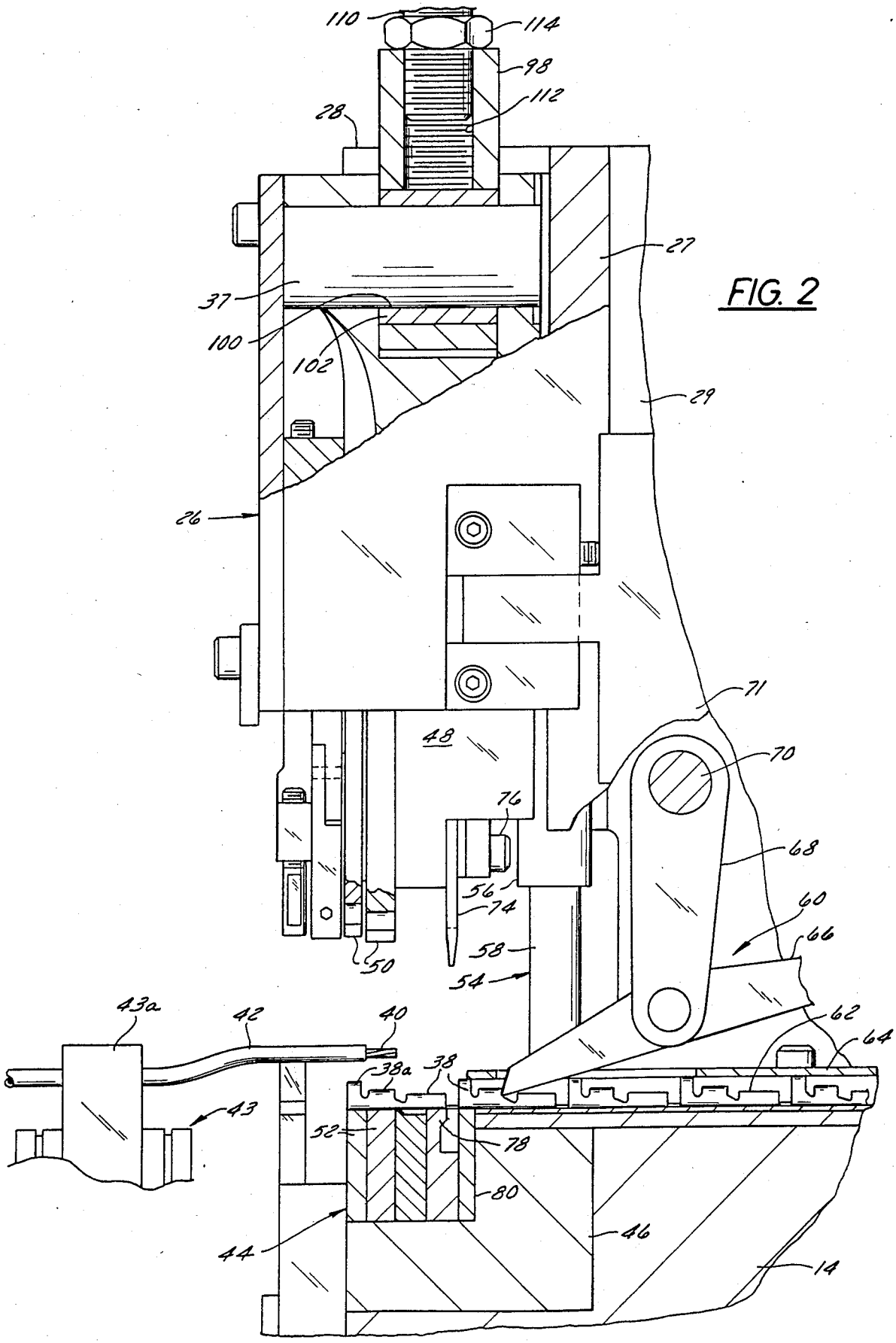
FIG. 2 is a side view, partially in section, of the crimping portion of the apparatus shown in FIG. 1.

Referring now to FIGS. 1 and 2, there is shown a terminal applicator 10 constructed according to the invention. This embodiment of the terminal applicator 10 preferably includes a body or frame 12 assembled from a base plate 14 and several side plates 16 secured thereto for supporting a power unit 18. The power unit includes a motor 20 which is operatively connected via any suitable drive means (not shown), such as belt-, chainor gear-type drive means, to drive a shaft 22 mounted for rotary motion in a housing 24 attached to the side plates 16. A sliding shuttle 26 is mounted to an L-shaped die plate 27 and slidably retained by dove tail guides 28 thereon. The die plate 27 is mounted to a cross plate 29 between the two side plates 16. Shuttle 26 is moved in a generally vertical direction in a reciprocating motion along dove tail guides 28 by means of a link assembly 30, which in turn is actuated by an actuator assembly 32. In the embodiment shown in FIG. 1 the actuator assembly 32 includes a crankpin 36 which is eccentrically mounted on the a shaft 22. The link assembly 30 is attached between this crankpin 36 and a shuttle pin 37 provided in shuttle 26 (FIG. 2). In effect the link assembly 30 thus converts the rotary motion of the crankpin 36 to the linear reciprocating motion required of the shuttle 26.

The Terminal Applicator

Figure 3:
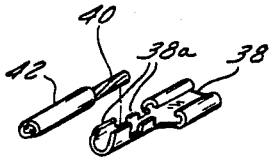
FIG. 3 is an isometric view of a stripped end of a wire lead positioned over a terminal, before the lead and terminal are attached to each other.

The terminal applicator 10 of this invention is used to automatically secure an electrical terminal 38 to the stripped end 40 of a wire lead 42, as shown in aligned position isometrically in FIG. 3. Referring again to FIGS. 1 and 2, the stripped end 40 of the wire lead 42 is aligned over the terminal 38 by any suitable conveyor means 43, and particularly by a gripping means 43*a* of the conveyor 43. After such alignment, the electric terminals 38 are crimped to the end 40 of the wire lead 42 by means of a die set 44. The die set 44 includes a fixed die shoe 46 and a moving die shoe 48, as shown best in FIG. 2. The moving die shoe 48 is affixed to the sliding shuttle 26 for movement therewith. The fixed die shoe 46 is secured to the die plate 27. A crimping die 50 is secured to the moving die shoe 48 in a position to operatively engage an anvil 52 which is secured to the fixed die shoe 46. Accuracy in alignment of the anvil 52 with the crimping die 50 is provided by a telescoping guide means 54. This guide means 54 includes an outer tube 56 positioned and sized on the moving die shoe 48 so as to project downward and just fit over a correspondingly sized and positioned inner tube 58 which projects upward from its attachment point on the fixed die shoe 46. The anvil 52 has an arcuate upper surface for providing support to the terminal 38 during the crimping operation. The crimping die 50 includes a curved crimping surface which is used to crimp the ears 38*a* of the terminal 38 (FIG. 3) against the insulation and/or the wire, depending upon the type of terminal.

The applicator 10 also includes apparatus 60 for advancing the terminals 38 into place before attachment to the stripped wire ends 40. Generally a number of the terminals 38 are attached together to form a terminal chain 62, which is usually stored on and fed from a reel (not shown). The terminal chain 62 is fed through a tube or guide 64 provided on the fixed shoe 46. The terminal chain 62 is advanced in a step-by-step manner by a pawl 66 which is mounted on the end of a lever arm 68. Lever arm 68 is affixed to a pivot pin 70 journaled in an attachment housing 71 of advancement apparatus 60, which is in turn attached to the base plate 14. The pawl 66 is biased into engagement with the terminal chain 62 by a spring 72 and is moved forward on the downward motion of the shuttle 26, by suitable drive means (not shown), to push the terminal chain 62 forward in the guide 64. The pivot pin 70 is biased to thereafter return the pawl 66 to its initial position by another spring (not shown).

Figure 6:
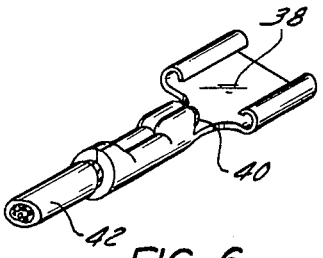
FIG. 6 is an isometric view, on a larger scale, of a stripped end of a wire lead after being crimped onto a terminal.

Each individual terminal 38 is cut from the terminal chain 62 by the motion of the shuttle 26, as follows, referring to FIGS. 2 and 5. A cutter blade 74 is secured to the moving die shoe 48 by any suitable removable means such as one or more bolts 76. This cutter blade 74 is aligned with and cooperates with a cut off die 78 which is secured to a cut off block 80. Thus as the upper die shoe 48 moves into engagement with the lower die shoe 46, the cutter blade 74 also moves into engagement with the cut off die 78 to cut the individual terminal 38 from the terminal chain 62. The result is, as shown in FIG. 6, a wire lead 42 with a stripped end 40 having a terminal 38 permanently attached thereto.

Figure 4:
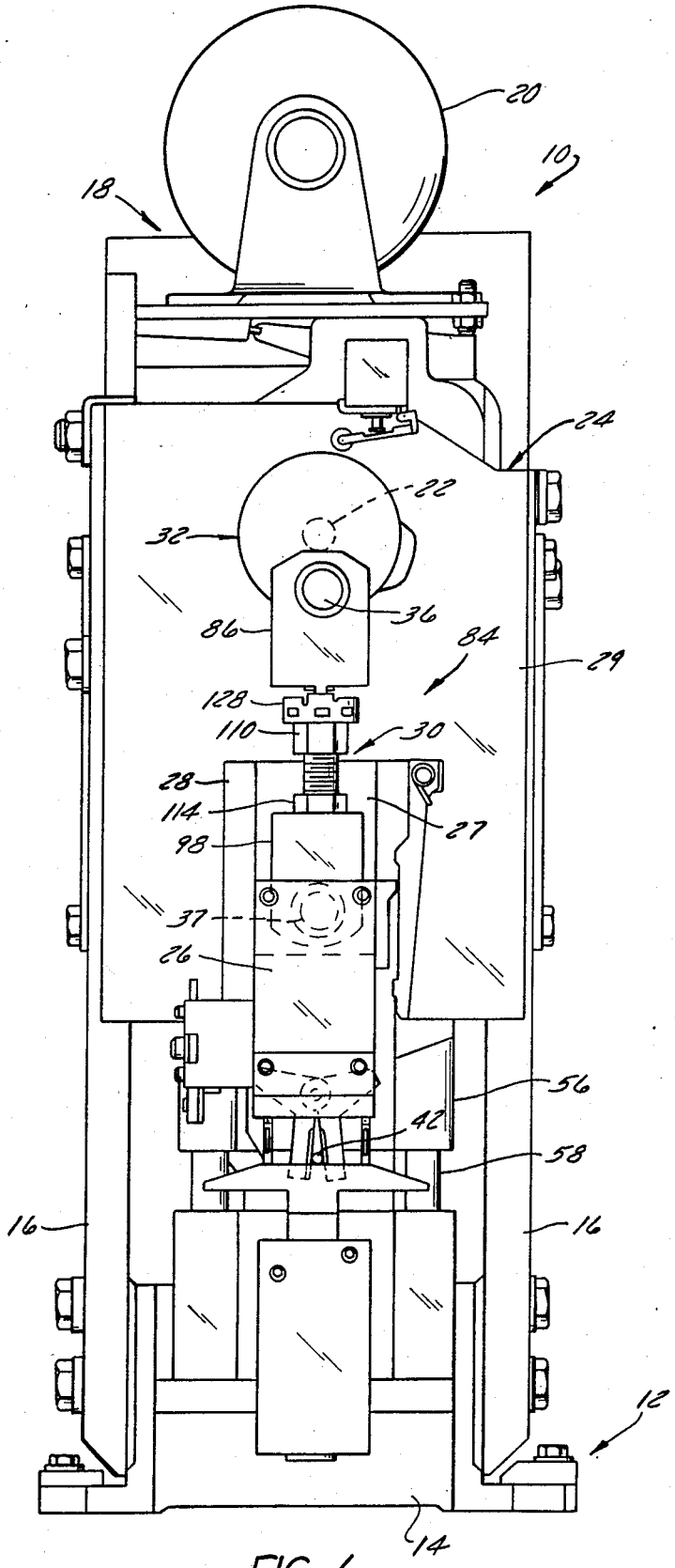
FIG. 4 is a similar view to FIG. 1, showing the same apparatus with the link and die in the lowered position.
Figure 5:
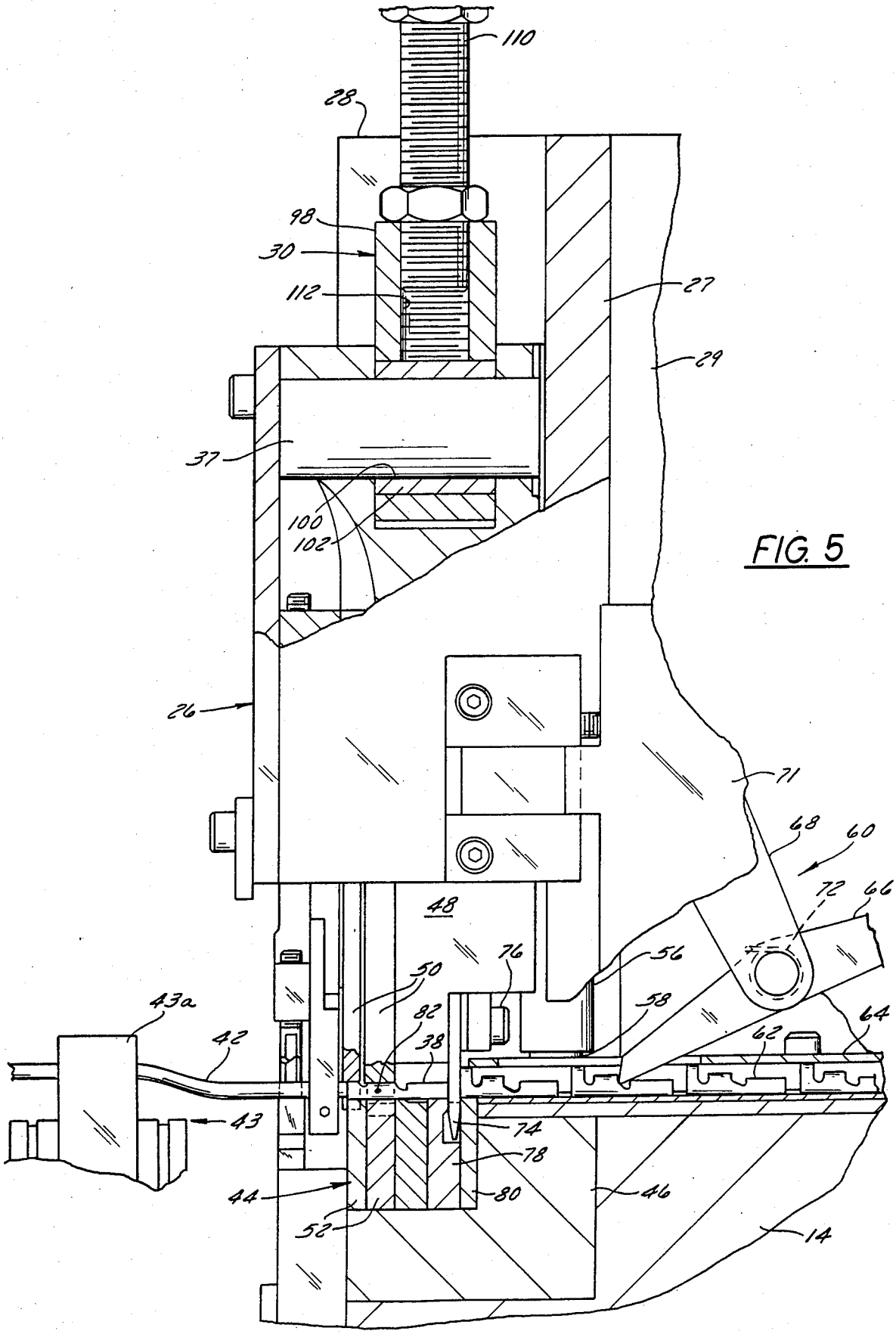
FIG. 5 is a view similar to FIG. 2, showing the same apparatus with the link and die in the lowered position.

The position shown in FIGS. 4 and 5 is the crimping position, where a terminal 38 is attached to a stripped end 40 of a wire lead 42 by engagement of the crimping die 50 with the terminal, with the anvil 52 holding the terminal in place. As can be seen in FIG. 5, there is required to be a certain amount of clearance 82 between the crimping die 50 and the anvil 52, to accommodate the size of the particular type of terminal 38 in use. The size of this clearance 82 is adjusted by changing the length of the link assembly 30. Since the clearance required by each type of terminal 38 is independent of the clearance required by any other such type of terminal 38, it follows that the clearance 82, and thus the length of link assembly 30, may have to be adjusted with each different run of the terminal applicator 10, and certainly each time the type of terminal is changed.

In previously known terminal applicators of the type described above the only way to adjust the length of the link assembly was, as previously described, to loosen two lock nuts, turn a threaded rod for the actual length adjustment, and retighten the lock nuts. As referred to above, this procedure was time consuming, based on trial and error, and thus also wasteful of the materials used in the trials. As a solution to this problem, therefore, link assembly 30 includes means, indicated generally at 84, for changing its length without complicated and time consuming mechanical adjustments. Clearly, such a length changing means 84 vastly improves changeover times, thus increasing productivity and profitability particularly with respect to smaller volume production runs. Further, length changing means 84 is stepwise adjustable, employing three steps in the preferred embodiment, to facilitate changing the length of the link assembly 30 in discrete, predetermined amounts, determined by the clearance 82 required by the most commonly used terminals 38.

The Link Assembly

Figure 7:
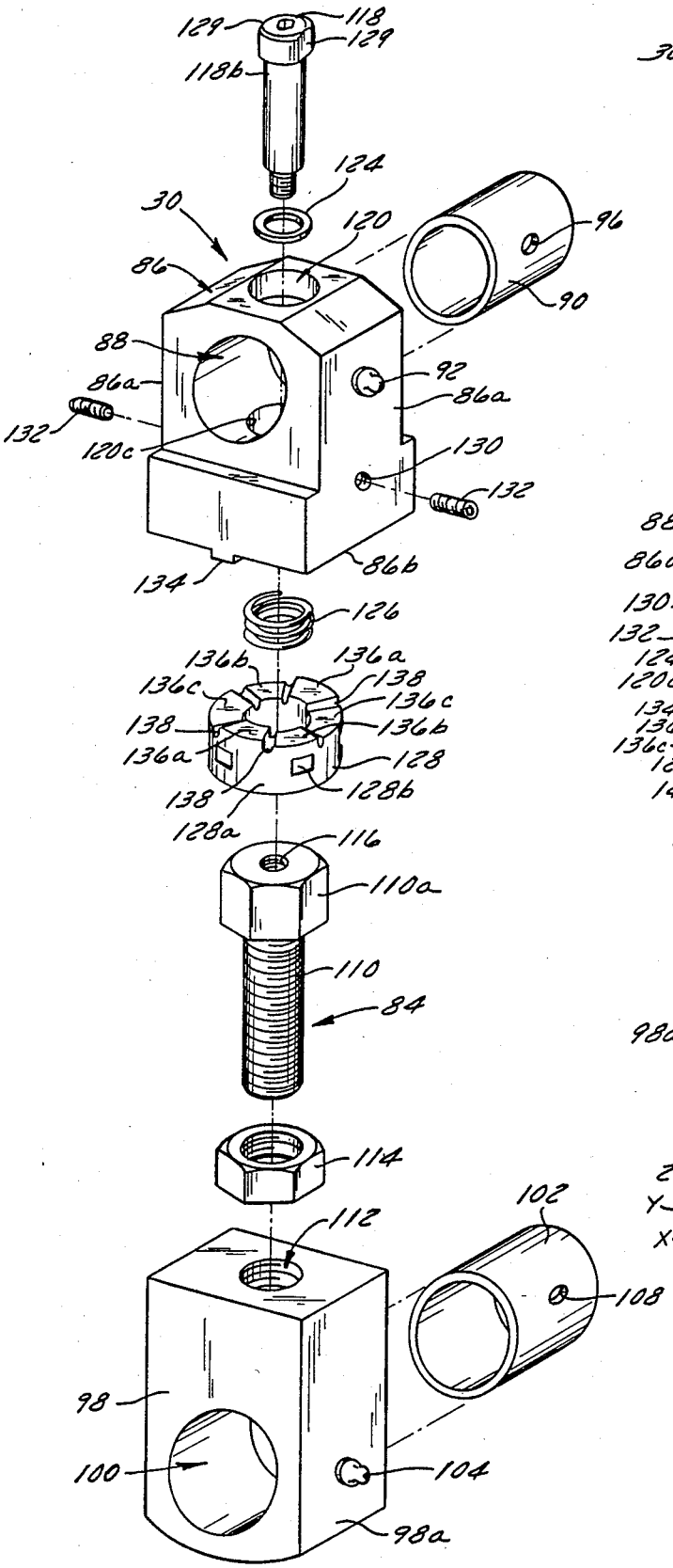
FIG. 7 is an exploded isometric view of a link constructed according to the invention.
Figure 8:
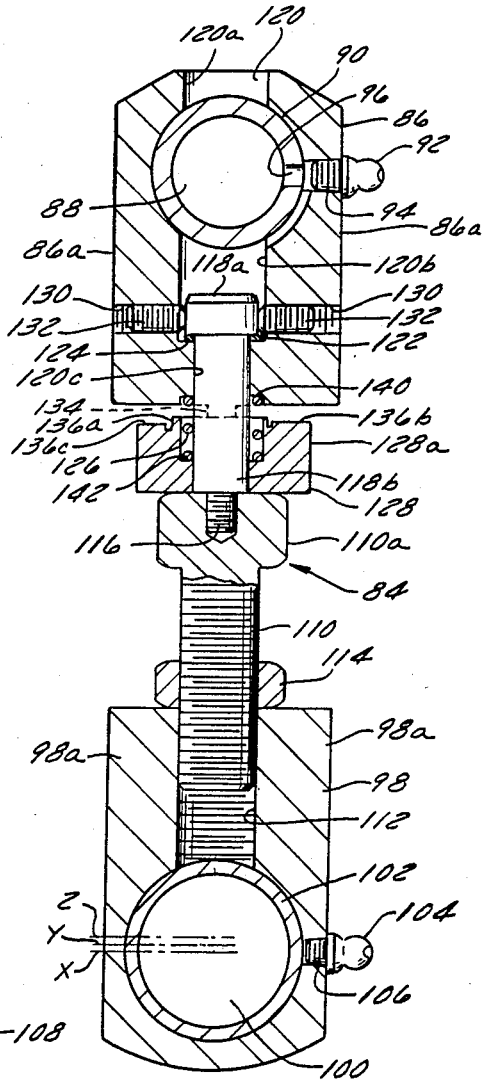
FIG. 8 is a cross-sectional view of a link constructed according to the invention.

The link assembly 30 is shown in more detail in FIGS. 7 and 8. Referring now to those figures, the link assembly 30 includes means for attaching its upper end to the crankpin 36 (FIGS. 1 and 4), in particular including an upper end block 86 having a cylindrical aperture 88 formed transversely therein for acceptance of the crankpin 36. In the preferred embodiment the aperture 88 may have press fitted therein a bushing 90 for reducing wear on the upper end block 86 and extending its useful life. To further reduce wear, a lubrication means 92 may be provided in an opening 94 in one of the side surfaces 86*a* of the upper end block 86. A corresponding opening 96 is provided in bushing 90 to allow the lubrication applied via fitting 92 to reach the space between the bushing 90 and the crankpin 36.

The link assembly 30 further includes means for attaching its lower end to the shuttle 26, particularly including a lower end block 98 having a cylindrical aperture 100 formed transversely therein for acceptance of shuttle pin 37 (FIGS. 2 and 5). Similar to upper end block 86, lower end block 98 preferably has a bushing 102 press fitted into aperture 100 so as to reduce wear on the end block. Once again, a lubrication means 104 is provided in an opening 106 in one of the side surfaces 98*a* of lower end block 98 to further reduce wear. A corresponding opening 108 is provided in bushing 102 to allow the lubrication to reach the space between the bushing 102 and the shuttle pin 37.

Upper end block 86 and lower end block 98 are connected together by length changing means 84 as referred to above. In the preferred embodiment, length changing means 84 includes an adjusting bolt 110 threaded partway into a tapped hole 112 formed vertically in the top surface 98*b* of the lower end block 98. A lock nut 114 has been first applied to the adjusting bolt 110 so that after the application of the bolt to the lower end block 98, the nut 114 may be tightened down and thereby prevent further rotation of the bolt with respect to the lower end block. The head 110*a* of adjusting bolt 110 also has a tapped hole 116. A shoulder bolt 118 is inserted axially through a vertical cylindrical opening 120 in upper end block 86 prior to the bushing 90 being press fitted in transverse aperture 88 as described above.

Vertical cylindrical opening 120 can be separated into three parts within upper end block 86. The upper portion 120*a* is the portion of vertical opening 120 located above transverse aperture 88 and is sized to accommodate the head 118*a* of shoulder bolt 118. The lower portion 120*b* is the section located just below the transverse aperture 88 and is also sized to accommodate the head 118*a* of the shoulder bolt 118. Finally the bottom portion 120*c* of vertical opening 120 is located at the bottom of upper end block 86, below lower portion 120*b*. Bottom portion 120*c* is sized so as to accommodate only the shank portion 118*b* of the shoulder bolt 118. There is thus a ledge 122 at the point where the size of opening 120 changes from the size to accommodate the shoulder bolt head 118*a* to the size to accommodate the shank 118*b*. After the shoulder bolt 118 is installed in upper end block 86, its head 118*a* rests on this ledge 122, or alternatively on a washer 124 which in turn rests on the ledge as shown in FIG. 8.

Once installed in the upper end block 86, the shoulder bolt 118 is inserted through a coil spring 126 and an annular spacer 128. Spring 126 and spacer 128 fit sufficiently loosely about the shoulder bolt 118 so as to allow relative rotational motion of the spacer 128 around the bolt 118. The shoulder bolt 118 is then threaded into the tapped hole 116 in the head 110*a* of adjusting bolt 110, and tightened until the shoulder 118*c* of the shoulder bolt 118 butts against the head 110*a*. The shoulder bolt head 118*a* preferably has at least two flat sides 129, preferably opposing each other. One or more tapped holes 130 are provided in the sides of upper end block 86, extending from the outer surface thereof and communicating with the vertical opening 120 at a point just above ledge 122. These tapped holes 130 accommodate set screws 132, the inner ends of each of which bear upon the flat sides 129 when tightened, thereby preventing rotational motion of shoulder bolt 118 during assembly, and to facilitate disassembly. During operation and normal use of the link assembly 30, these set screws 132 are backed off and are not in contact with the flat sides 129 of the bolt head 118*a*.

The Spacer

Figure 9:
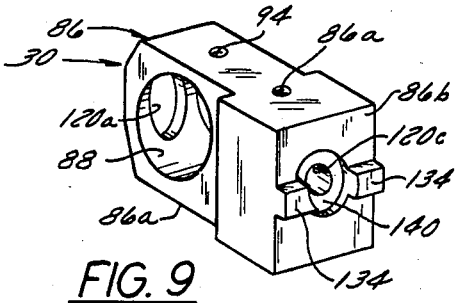
FIG. 9 is a bottom isometric view, on a reduced scale, of an upper end block constructed according to one embodiment of the invention.

As shown best in FIG. 9, bottom surface 86*b* of upper end block 86 includes a ridge 134 along the center of the block 86 and parallel to the transverse aperture 88. As can be seen there, the ridge 134 is interrupted only by the vertical opening 120. The particular orientation of the ridge 134 is not critical, although it is required to pass over the center of the bottom surface 86*b*. Referring again to FIGS. 7 and 8, the upper surface of the annular spacer 128 can be seen to be divided into a plurality of upwardly facing, substantially keystone-shaped segments 136. Each adjacent pair of such segments 136 may be separated by a trough 138, such as to facilitate manufacture. Each of the raised segments 136 has the same top surface area. The raised segments 136 are arranged in opposing pairs 136*a*, 136*b* and 136*c*. Each segment of a matching pair is axially offset to exactly the same level as its opposing segment, and each of the pairs has an axial offset that is different from the offset of any of the other pairs. The width of the ridge 134 of upper end block 86 must be no greater than the narrowest point of any of these segments 136. Thus, according to the invention, the upper surface of the spacer 128 is provided with three steps of axial offset, each step having a matching pair of segments of the upper surface of the spacer.

The function of the spacer 128 is to easily and quickly change the distance between the bottom surface 86*b* of the upper end block 86 and the head 110*a* of the adjusting bolt 110. This in effect changes the length of the link assembly 30, thereby in turn changing the clearance 82 (FIG. 5) between the crimping die 50 and the anvil 52. Assuming that the center point of the transverse aperture 88 in the upper end block 86 remains stationary, the three different levels x, y and z of axial offset of the spacer segments 136 as shown in FIG. 8 result in the three different positions X, Y and Z of the center point of the transverse aperture 100 in the lower end block 98. A change from any one of these positions X, Y and Z to any other of the positions is accomplished by rotating the spacer 128 about its vertical axis approximately 60 degrees at a time so that the adjacent opposing pair 136*a*, 136*b* or 136*c* of spacer segments bears on the ridge 134 of the upper end block 86, until the desired position is reached.

The coil spring 126 is provided for normally biasing the spacer 128 away from the bottom surface 86*b* of the upper end block 86 and toward the head 110*a* of the adjusting bolt 110. This arrangement facilitates the easy turning of the spacer 128 so that an operator can quickly and easily change the selected segment pairs 136*a*, 136*b* or 136*c* which bear on the ridge 134, when the anvil 52 is not being engaged by the crimping die. It is important that the location of the ledge 122, the length of the shank 118*b* of the shoulder bolt 118 and the thickness of the spacer 128 at the highest level x of axial offset are such that there is substantially no clearance between the respective segment 136 and the bottom surface 86*b*. Hence when the link assembly 30 is used with the spacer 128 in this position there is no slack in the length of the link assembly 30. In addition, when the spacer is set at the other positions y and z, any such slack is taken up by the coil spring 126, reducing the impact loading on the link assembly 30 in use. The coil spring 126 is not intended by itself to have any effect on the clearance 82 between the anvil 52 and the crimping die 50 in its crimping position as shown in FIG. 5. When positions y and z of the spacer are used, the coil spring 126 merely biases the spacer 128 away from the bottom surface 86*a* of the upper end block 86 until the crimping die 50 first engages the terminal 38 (FIG. 5). At that point the spring 126 compresses until the selected segment pair 136 bears on the ridge 134, when the link assembly 30 effectively becomes a solid, load bearing member for transferring the force exerted by the crank assembly 32 to the shuttle 26. Annular ledges 140 and 142 may be provided in the bottom surface 86*a* of the upper end block 86 and the upper surface of the spacer 128 respectively, surrounding and coaxial with the apertures formed in those members to accommodate the shoulder bolt 118. The coil spring 126 then bears between these two respective ledges 140 and 142.

The outer surface 128*a* of the spacer 128 generally has means for facilitating the rotational selection of segment pairs 136. In particular, as shown in isometric in FIG. 7, a plurality of flats 128*b* are provided about the outer surface 128*a*, for use with a tool (not shown) in rotating the spacer 128 until the proper segment pairs 136 are selected. Alternatively, the outer surface 128*a* may have a hexagonal shape, similar to that of adjustable bolt head 110*a* or lock nut 114 for facilitating the required rotation. Another alternative, which may be combined with the flats 128*b*, is to knurl the outer surface 128*a* so that the spacer 128 may be rotated manually without tools if possible, and by use of tools bearing on the flats 128*b* if necessary.

While the apparatus hereinbefore described is effectively adapted to fulfill the aforesaid objects, it is to be understood that the invention is not intended to be limited to the particular preferred embodiments of terminal applicator having quick-adjust connecting link herein set forth. Rather, it is to be taken as including all reasonable equivalents without departing from the scope of the appended claims.

What is claimed as the invention is:

1. Apparatus for crimping a terminal onto a stripped end of a wire lead, comprising:

a frame;

an anvil positioned on said frame;

a die mounted on said frame so as to be slidable thereon in a predetermined direction, positioned so as to align with said anvil in said direction, and spaced apart from said anvil in said direction by at least a minimum clearance;

an actuator, for imparting reciprocating motion along said predetermined direction to link means;

said link means assembled to said die and said actuator for transferring said reciprocating motion from said actuator to said die, said link means having a variable length to allow alteration of the minimum clearance between said die and said anvil and comprising:

threaded length adjustment means for adjusting the length of said link means, and in turn for adjusting said minimum clearance, during setup and assembly of said apparatus; and stepwise length adjustment means for adjusting the length of said link means between production runs of said apparatus.

2. An apparatus as recited in claim 1 wherein said link means further comprises first connecting means for connecting said link to said die and second connecting means for connecting said link to said actuator;

said threaded adjustment means including an adjusting bolt engaged with one of said first and second connecting means;

said link means further including a shoulder bolt for connecting the other of said first and second connecting means to said adjusting bolt; and said stepwise adjustment means including an annular spacer positioned between said adjusting bolt and said other of said connecting means and adapted to be rotatable with respect to said other of said connecting means and said adjusting bolt, said spacer having a plurality of opposing pairs of axially raised segments spaced substantially equally about its periphery, each segment of a matching pair being axially offset to substantially the same level as its opposing segment, each of the pairs having an axial offset that is different from the offset of any of the other pairs, and each of said segment pairs being selectively engageable with a ridge on said other of said connecting means.

3. An apparatus as recited in claim 2 wherein said annular spacer includes means for facilitating the rotation of said spacer with respect to said other of said first and second connecting means.

4. An apparatus as recited in claim 2 wherein the peripheral surface of said annular spacer is knurled for facilitating the rotation of said spacer with respect to said other of said first and second connecting means.

5. An apparatus as recited in claim 2 or 3 or 4 wherein the peripheral surface of said annular spacer includes a plurality of flats for facilitating the rotation of said spacer with respect to said other of said first and second connecting means.

6. An apparatus as recited in claim 4 wherein said stepwise adjustment means further includes biasing means for biasing said spacer away from said other of said connecting means.

* * * * *